United States Patent [19]

LaPorta et al.

[11] 3,951,032

[45] Apr. 20, 1976

[54] MUFFLER-BRAKES FOR DRUMS

[76] Inventors: Louis F. LaPorta, 11421 S. Western Ave., Chicago, Ill. 60643; David S. Goldsmith, 8359 S. Crandon Ave., Chicago, Ill. 60617

[22] Filed: July 23, 1974

[21] Appl. No.: 490,989

[52] U.S. Cl. ..... 84/419

[51] Int. Cl.[2] ..... G10D 13/04

[58] Field of Search ..... 84/411, 414, 417, 419

[56] References Cited

UNITED STATES PATENTS

| | | | |
|---|---|---|---|
| 1,045,357 | 11/1912 | Anderson | 84/411 X |
| 1,892,223 | 12/1932 | Sansone et al. | 84/419 |
| 2,499,616 | 3/1950 | Walberg | 84/411 |
| 2,564,933 | 8/1951 | Somerville | 84/411 |
| 2,572,504 | 10/1951 | Meriwether | 84/411 |
| 2,655,071 | 10/1953 | Levay | 84/411 X |
| 3,433,115 | 3/1969 | Kjelstrom | 84/411 |

*Primary Examiner*—Lawrence R. Franklin

[57] ABSTRACT

This invention relates to a foot-operated Bowden type cable mechanism which is operatively associated with a padded damping plate whose incidence with the underside of a timpano membrane, for example, terminates its vibration. If the device of the invention is actuated prior to the delivery of an exciting blow, operation is as a muffler or mute.

In an alternate embodiment, an electromechanical actuator is mounted so as to allow the silent and hand-free muffling or silencing of a timpano. Typically, the actuator is a direct current energized solenoid mounted internally to the drum. This solenoid is of the push type, the magnetically nonsusceptible plunger-extension being directed upwards and conveying to the underside of the timpano membrane the camping plate with overlying padding whose incidence with the membrane mutes or terminates its vibration. A foot switch permits hands-free operation.

9 Claims, 6 Drawing Figures

MUFFLER-BRAKES FOR DRUMS

BACKGROUND

The present invention relates to discretionary or semiautomatic muffler-brakes for drums. More specifically, the invention relates to mechanical and electromechanical timpano muffler-brakes of discretionary operation. By discretionary operation is meant that damper actuation is under the direct control of the timpanist who is thus free to use the damper in a way that responds to the artistic requirements at any given point in the music. Artistic requirements comprehend the capacity for directing the damping action to any individual drum in a full set or kit and that the instant at which such action is accomplished is determined solely by the artistic judgment of the timpanist, which is not compromised due to any inbuilt limitation of the mechanism.

An example of a non-discretionary muffler is that mentioned in U.S. Pat. No. 2,548,271: 5; 56–59, which as similar mufflers in ordinary tom-toms, bass, and snare drums, is adjusted to a certain setting which represents a corresponding degree of intensity suppression, and thereafter imposes that some degree of abatement upon all succeeding playing such that this modification to the tone of the instrument is alterable only by once again adjusting the muffling mechanism.

Whereas the character of an exciting blow is subject to wider variance responding to artistic requirements, the character of a cutoff or stifling action entails vibratory extinction and is therefore most often merely categorical. With the timpano, it is rare that the player wants the sound extinguished in a way other than such as simply to secure immediate and total silencing. Nevertheless, the damping action keeps occupied a hand that might otherwise have proceeded to beat another drum. Thus, apart from the instant at which such action is brought in relation to the musical score, damping is itself usually devoid of, and indeed interferes with the attainment of, artistry.

In addition to facilitating the execution of the existing repertoire, provision of a foot-actuated discretionary damper permits the reasonable composition and execution of passages heretofore regarded as simply unplayable. Additionally, provision of a hands-free damper allows accession of the timpano to a more nearly staccato or secco quality as represented by its wave envelope, notwithstanding the relative slowness of speech of the instrument. The significance of this last factor may be illustrated by alluding very briefly to a few sentences by Brindle in Contemporary Percussion, Oxford University Press (London: 1970), p. 157: "Though timpani can be played rapidly, the sounds will not be sharp and clean, but will tend to merge together into a booming roar which may be the very opposite of the rapid, staccato effect the composer probably intended. This is particularly so when a large number of instruments are used, as in rapid passages the player has no time to damp out unwanted sounds (including sympathetic vibrations)."

Materially augmenting the overall technical facility inured through use of the device, is the fact that the position of the pedals on the floor is at the discretion of the player. This possibility inheres in push-pull remote cable controls of which the Bowden, for example, is a kind. When such a control is used, there is no necessity to permanently affix it to the instrument upon which its controlling function is exerted. This situation is equally true in the case of the electrical foot switch. This may appear to be unimportant to the acquisition of augmented technical facility, however it is of considerable meaning in the connection. If, for example, it is necessary to play successively with a high degree of speed, drums situated to either side of the player, it is preferable, especially if a somewhat staccato quality is desired on the final ictuses of drum-alternating rolls, that the pedal controls respective of the two drums concerned be situated not alongside them, but rather alongside the opposite drums. Because when the pedals are so positioned, the player is motionally freed not just to the extent of eliminating the necessity for having his hand physically associated with the drum to be damped, but further to the extent that he can freely rotate the upper portion of his torso. Thus, not just his hand, but his entire body, and for that matter his overall position in relation to the drums, is freed. The player can, as the situation requires, damp a drum he no longer faces, and for this reason, can have betimes proceeded to face the drum yet to be played. Thus the speed with which a staccato effect can be produced with drums at opposite sides of the player as described is significantly increased, while at the same time, the action is accomplished at far more comfort to the player. The player is understood to plan ahead as to what the relative positions of the foot controls shall be, just as he plans the other elements of his performance.

Generally speaking, the various timpani will be arranged in a semicircular formation, with their relative registers rising from left to right. The foot controls then, will in most instances be arranged reversely of this, meaning for example, that that most clockwise will control the drum of lowest register. Normally the radius of this semicircular arrangement of foot controls will be such as to permit a single foot, by means of pivoting on the heel, to operate any one of them. Alternative arrangements are possible, as the relative placement of the foot controls among the drums and themselves is open. Thus, for example, that three or so foot controls may, whether their cables cross over, so to speak, be operated simultaneously by either foot, is considered self evident. All remarks as to placement relate to both uses.

Machine tuning in the timpano provides a continuously variable tautening means over the usable pitch range appropriate to the instrument, and such means are incapable of simply terminating head vibration. Rather, the pedal is used to vary the pitch to which the head is normatively or medianly set by the hand screws. Thus, if one depresses the pedal on a drum incorporating such a mechanism until it be caused to reach the downward limit of overall stroke, the effect thereof is to maximally tauten the head, thereby securing the highest pitch the pedal can provide relative to the degree of tautness initially set by the hand screws. If one depresses the pedal subsequent to membrane excitation, the effect thereof is to produce a glissando effect whereby the pitch is made to slide or sweep upwards while the tone continues to sound. Such tuning means are taught in U.S. Pat. Nos. 1,282,406; 1,561,789; 1,755,569; 2,074,194; and 3,021,743 among many others, both foreign and domestic. It is perhaps superfluous to point out that hand tuning means such as that taught in U.S. Pat. No. 2,587,310 are especially devoid of applicability to the end presently sought. Similarly irrelevent is the foot actuated sound quality altering means shown in U.S. Pat. No. 2,548,271, already mentioned in connection with the non-discretionary mute further alluded to therein.

Equally impertinent are the various existing dampers and mutes seen as parts of other instruments. Included among these are dampers seen in pianos, harpsichords, clavichords, vibraphones, and cimbaloms.

The dampers in these instruments fall into either of two categories, neither of which is properly transferrable to the timpani. This is at least partially attributable to certain peculiarities of membranophone vibration (see Taylor, The Timpani, John Baker, (London: 1964) which necessitate spanning of the generative element by the damper to a greater extent. When actuated rapidly, an ineluctable condition in an unmodified solenoid-encorporating embodiment, a large flat surface, notwithstanding the overlying padding, tends to produce an unacceptable amount of noise. Additionally, such a surface interferes with the passage of pressure wave trains internal to the drum, which in the timpani, if somewhat less so in snare drums, ought not to be deflected thus. The first category to which allusion is had includes those dampers of no mechanical connection to the sound exciting means and which are normally of in-use disposition. Dampers of this kind are lifted away from the vibratory elements when the player depresses the pedal that serves this purpose. Into this withdrawal over the entire range type damper category belong the cimbalom and vibraphone. In the other instruments previously specified, a second category is defined by immediate mechanical connection of the damping means to the other mechanical elements in the various individual actions or exciting means. This being the case, damper withdrawal occurs only during and as a part of the overall action resulting from actuation of the exciting means, unless such action is deliberately overriden by means of depressing the damper or sostenuto pedal, the effect of which is to withdraw all dampers from their respective strings simultaneously. It may be seen that the latter is precisely the same as the former, save that additional means are included that are discretionary for the individual tones, a circumstance allowed by the provision for each such tone of its own key and action. The latter category comprehends the familiar piano, where the dampers are in a normally in-use position until they are lifted from the string on actuation of the action belonging to it. This permits ensurance that each tone of the instrument may be sounded alone, rather than have sounded with it those other tones bearing an harmonic relationship to it and which because of this, would be excited to sympathetic vibration with it, were not these latter restricted from doing so by the aforedescribed damping means. The discretionary damping means, as opposed to the overriding means akin the type in the cimbalom, allows vibration to be ended immpediately as the finger is withdrawn from the digital or key. Actuation of the sostenuto pedal then, allows the tone to die away slowly and further be colored by the sympathetic vibration of those strings tuned to tones bearing an harmonic relationship to the tone of reference. This is so, since as indicated, depression of this pedal lifts all dampers from their respective strings simultaneously, against the circumstance that these actuate individually as an inherent and necessary element in causing the tone to which they respectively accord to be sounded.

While it may be seen that the only barrier to timpani application is merely that all these dampers function in a normally in-use position so that simply reversing the operation so as to proceed in a normally out of use positioning would begin to satisfy the requirements peculiar to the timpano, the history of the instrument appears to disclose no such insight on the part of those skilled in the art. Also, it is to be clarified that a set of timpani in fact conform to what is an assemblage of separate musical instruments, which are accordingly spatially discontinuous, used albeit, in direct proximity to one another. Such separation among generating elements disallows a simple transfer of such damping means as are nondiscretionary for specific generating elements within a single instrument body and discretionary thus by reason of direct mechanical connection. Additionally, in a clavier type instrument, it is allowed as enrichening of the tone that harmonically related vibratory elements sound with it on depressing the sostenuto pedal. With the timpani, sympathetic or coercive cross resonance is often taken as objectionable (see Brindle's remark, op cit and Frazeur's in the Percussionist, "Some Thoughts on Timpani and Intonation," Vol. 6; No. 4, May, 1969; p. 116.)

Occasionally, a musical score will direct the player to take a certain passage with partial muffling on con sordino. In this playing effect, the membrane is partially damped prior to being beaten. In the absence of the invented mechanism, this technique is limited in its use to the playing of a single timpano at a given moment owing to the necessity for manual participation in the operation. Obviously, use of the present invention allows partial muffling of two or more timpani simultaneously, it being understood that the device of invention function as a mute if actuated prior to bearing. As previously indicated, the term mute refers to a reduction in sound power output effected by actuation of the device of invention prior to bearing, whereas the term damping refers to extinguishing of the sound subsequent to its unobstructed onset. This corresponds to muting by laying a finger against the membrane prior to beating to mute and so on, the advantage of the invented mechanism being primarily that it eliminates the necessity for using the hand and thus frees it to proceed playing further.

SUMMARY OF THE INVENTION

The invention may be summarized in specific terms as relating to an apparatus permitting a timpanist to mute or damp any of his timpani selectively and with complete freedom as to the precise instant during the unfolding of the musical selection that such action is caused to be undergone. This is further allowed in the absence of manual participation save for beating, and the motional freedom thus inured allows for a considerable augmentation in technical facility. This is because much of the technique of playing is tied up in skill at muting and damping, and these, with special reference to the latter, possess no inherent aesthetic character. That the foot control is freely situated imparts still greater motional freedom to the playing action, as previously explained.

OBJECTS OF THE INVENTION

A primary object of the present invention is the provision of a hands-free muting and damping means intended primarily for drums and especially for timpani.

Another object of the invention is the provision of devices fulfilling the foregoing purposes that minimize the necessary extent of motion engaged in by the player to achieve a given playing operation, especially with reference to the playing of several drums.

Yet another object of the invention is the provision of devices fulfilling the foregoing purposes that operate silently and do not alter or in any way detract from, the tonal character of the musical instruments to which they are applied.

Another object of the invention is the provision of devices which, by reason of their hand-freeing result, allow for an augmentation in the technical facility of playing and hence composition for, the timpano.

Another object of the invention is the provision of muting and damping means that make possible the playing of several instruments in a manner previously applicable to only one or two instruments, since beating and muting or damping operations had to be time-staggered if they were to be performed by the same hand.

Yet a further object of the invention is the provision of devices fulfilling all the foregoing functions, the foot controls of which may be freely situated.

Yet another object of the invention is the provision of a mute-damper suitable for the simultaneous control of several timpani that is of simple and well balanced construction, economically provided on a mass production basis; is sturdy and durable, being capable of a long service life of severe usage, and in this connection, is well able to withstand the abuses of being transported.

In an alternative embodiment of electromagnetic function, a further object shall be the achievement of the foregoing objects with the further provision that such function is nonmechanical and presents no moving parts.

An additional object in the case of an electromagnetic embodiment is the accomplishment of the foregoing objects without the presentation of physical contact between damper and membrane.

A further object of the present invention is to provide structural embodiments of the device which are readily constructed and permit the efficient use and operation thereof.

Other objects of the invention will in part be obvious and will in part appear hereinafter.

The invention accordingly comprises the features of construction, combination of elements, the arrangement of parts that will be exemplified in the construction hereinafter set forth, and the scope of the invention will be indicated in the claims.

For a fuller understanding of the nature and objects of the invention, reference should be had to the following detailed description taken in connection with the accompanying drawings in which.

Figure 1:
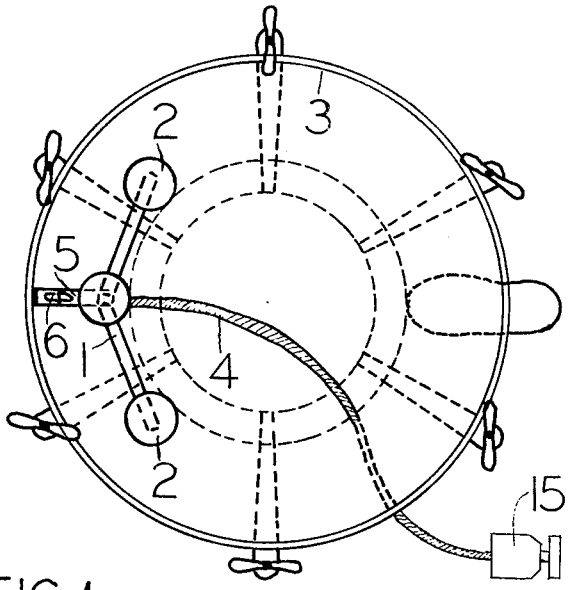
FIG. 1 is a plan elevational view looking down into the bowl of a timpano having had the device of invention installed within it.
Figure 3:
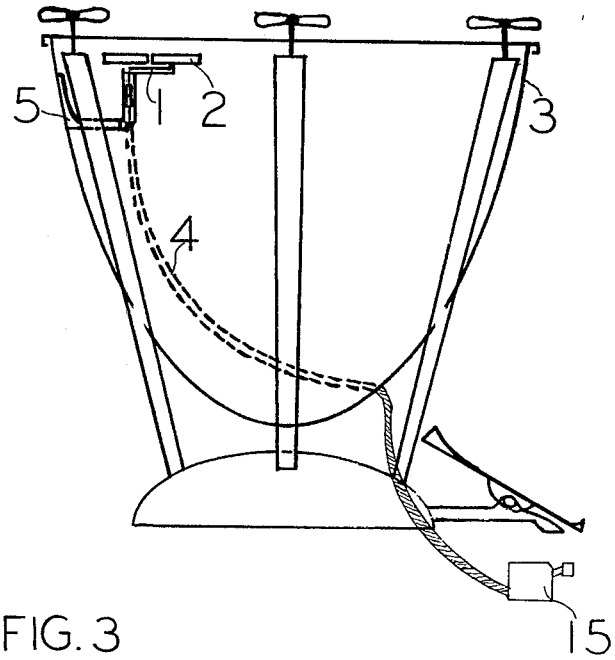
FIG. 3 is a side view corresponding to FIG. 1.

Referring to FIG. 1, shown is a form of damping plate 1 found to function with exceptional efficiency. It situates felt or foam covered hard discs 2 equidistantly along an arc substantially concentric with the outer rim of the shell 3. The diameter of these padded discs is on the order of 1.5–2.0 inches. Division of the damping plate 1 into three component areas allows a wider spanse of the vellum to be contacted, yet minimizes the degree to which the pressure waves are obstructed. This tripartite damping plate 1 is kept level in order that the upwards excursion of the damping plate 1 from its resting position to the point of contact is at a minimum. The concentric along which the arcuate formation is situated is approximately one-third the distance along the radius from the outer rim 3 to the center of the membrane or vellum (not numbered), a position corresponding to the concentric that represents the axis of primary and secondary vibrational areas of the vallum, according to the physics of membranophone sound generation in a case where the contained space is approximately hemispherical (see Taylor, The Timpani, John Baker, (London: 1964). The applicants have discovered that with three contact pressure points such as pertinent of the damping plate 1 shown in FIG. 1, it is not critical that the foregoing point of concentricity be used in order that damping be complete and effective. Rather, with three points, their placement on the membrane is no so critical, provided a certain minimum distance between them is provided. Were the case otherwise, it would be necessary to introduce a variable joint in the plate 1 such as one at the apex of the angle presented for scissors-like operation or it would be necessary to supply padded discs of ellipsoidal rather than circular shape that could be rotated to effect a greater or lesser radius of the membrane. The matter is mentioned only in the event that an unusual drum were encountered, such as one made for use by a child, which might then conceivably deviate from the normative range of timpano membrane diameters that such further means would thereby be made necessary of inclusion in the device. Within the sizes of membrane normally encountered, it does not appear necessary to include such further adjustable joints, at least provided a certain average disposition of the elements is secured in the first place. The piccolo timpano is rarely muted or damped.

Other effective forms of damping plate have been found. Successful damping plates are defined as those which produce the least contact noise, minimally obstruct the progress of the internal wave trains, and effectively terminate membrane vibration. Such a result is secured by providing an impact that at onset is cushioned and is frequently also of lesser contact area. As shall be understood further, it is best that both measures have been encorporated. If the surface of the damping plate 1 is continuous, there results an obstruction to the progress of the pressure waves internal to the drum which degrades the strength and quality of tone. To make the plate of discontinuous shape, such as that preferred and already described, allows these waves to pass to a greater extent than would a plate of continuous shape. That obturation of the internal resonant circuit would effect the period or largely eliminate it would appear obvious given a reflectional-resonant character based upon the internal configuration of the closed-off chamber. Depending upon the specific cushioning or padding material used, such intervening space between damping surfaces may also assist in undersurface impact noise reduction. This is so because such initial contact area may be progressively increased as the contacting stroke proceeds. The intervening spaces of reference may provide areas on the damping surface of the damping plate into which the progressively compressed damping material may expand. With the cushioning material compressed as the end of the stroke is reached, there is a final force applied to the membrane which then forcibly terminates its vibration. In this way, a stifling action can be made silent that would otherwise produce an unacceptable amount of noise in an embodiment encorporating a punching solenoid for example.

Another damping plate fulfilling the instant requirements may be described as a checker-board like formation, alternate squares thereof, so to speak, seating domes of cushioning material such as foam rubber, for example, and the squares between these being open. This is supported by a wire platform of ordinary right-angular form. The alternate open squares are intended to minimize wave obturation, of course. A variation of this plate would be that padded and remaining open in alternation by entire rows. The applicants have used damping plates topped with one-quarter inch thick foam rubber sheeting rolled into approximately one inch diameter cylinders disposed in rows as above with spaces alternating. Compression appears to present the correct resistance and compliance as the cylinders spread on contact. It will be appreciated later that the impact noise problem pertains most particularly to the embodiment that encorporates a solenoid, this element being of much speed, so that it effectually punches the membrane and the shock of this action must be dissipated. The compression of the padding formation presents no subjective correlate, being continuously and instantaneously merged.

Still referring to FIG. 1, it will be seen that the Bowden or other remote push-pull control cable 4 is lead away from the damping plate 1 to an emitting hole in the shell 3 that is of eccentric placement. Such placement stands to a side of whatever machine tuning means the timpano may include.

The damping plate 1 is contained in a sleeve (not shown in FIG. 1) that in turn is secured to the shell side 3 by the bracket 5. This bracket is in two pieces, the one length attaching to the other with a thunbscrew or wingnut, in point of fact the latter, that passes through a groove 6 in either portion. This provides a means for varying the length of the bracket 5 overall, which permits of alteration in the degree to which the bracket 5 extends towards the center of the drum from the shell wall 3. This being the case, it is possible for the bracket 5 to be used in combination with timpani of various sizes within the framework of the prior discussion.

The bracket 5, after a right angle bend in its outer or shellward portion, is affixed to the shell wall 3 by means of a wingnut-groove combination as that just described for the horizontal portion. That is, the groove defines a channel along which the shaft of the machine screw may be slid and secured by tightening at any point along its length, it being understood that it is the screw which is stationary and the bracket that is slid along thus. This thumbscrew or wingnut-groove arrangement again allows fitting of the device to any of a number of variously configured timpani. In certain timpani, the rate of flare of the sidewall of the shell is somewhat different than in others. This bracket 5 must be of such stiffness that it will not bob up and down subsequent to actuation. That the bracket 5 be substantially stiff is a requisite in all embodiments, it being clear that it must not be driven aback responsive to the action exerted towards the membrane as the reaction thereto, being the support from which such action is staged, and further with reference to electromechanical embodiments in particular, stiffness is necessary to prevent bobbing of such magnitude as to once again incide with the membrane subsequent to the deliberate withdrawal by the player of the plate. This would cause the drum to sound when it was intended that it be silent, of course, and in a case where there was indeed a subsequent beat intended, the interpolation of an additional and unwanted beat would produce a blurring interference.

Outwardly, installation of the device need not produce any conspicuous disfigurement, as all that shows is the securing fastener the outermost material of which may match that of which the shell is made. Specifically, the applicants use a brass blank head screw on copper ketles, for example. It will be appreciated that the wingnut fastening the wall portion of the bracket 5 communicates through the shell wall by way of a hole of the same diameter as its shaft and that the groove alluded to is in the unseen bracket 5 and is not cut out of the shell wall. Adjustment requires removing and replacing the head, but defacement and damage through further use to the drum are minimized. It may be stated that reheading of a modern timpano, having machine tuning means, and using a "Terelene" or "Mylar" head, is far simpler and quickly accomplished than was previously the case with animal skins and in the absence of any tuning assistive mechanism. Thus, mechanical, electromechanical, and electromagnetic embodiments as shall all be described herein may all be presented in externally supported form, if desired.

Figure 2:
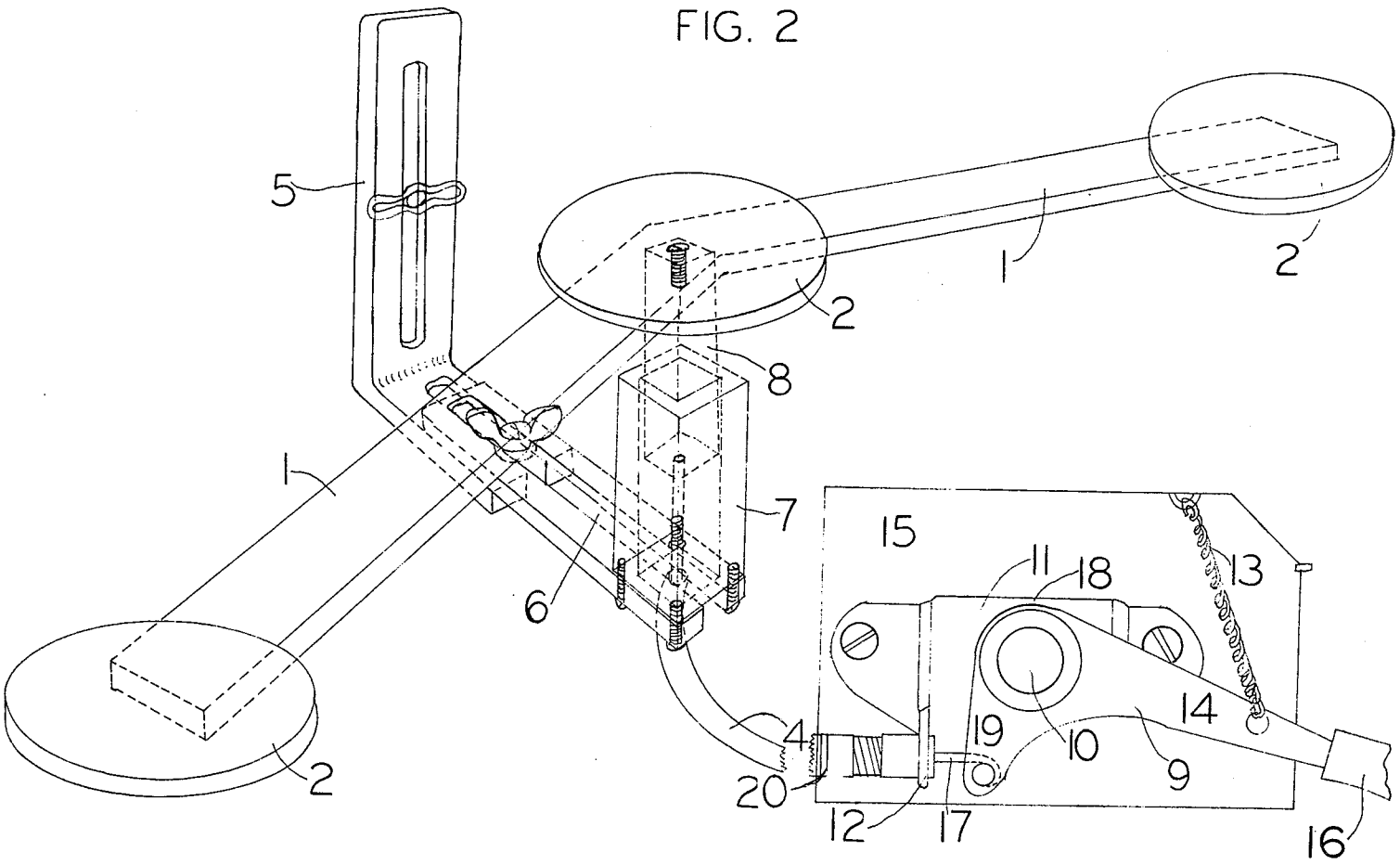
FIG. 2 is a perspective detail of the damping plate and cable in a mechanical embodiment with a detail of the foot control.

By referring to FIG. 2, it will be possible to see the character of the connection mediating the Bowden or other type push-pull remote control cable 4 and the damping plate 1. In particular, it will be noted that the sleeve 7, of which mention has already been made, that contains the shank 8 of the damping plate for retaining it in a vertical position and fixing a channel for its intermittent reciprocal motion, is of square configuration. This makes it impossible for the damping plate 1 to rotate, an action that would unpredictably displace the damping pads 2 from the correct position along the concentric representing the axis of maximal vibratory activity as previously mentioned. It should be understood that whereas placement of the device in differently sized instruments may take the damping plate out of concentricity, the action here represents a far more severe dysorientation, as in rotating, the plate can temporarily be disposed virtually at right angles to the disposition intended. While the prior condition is usually unnoticible, the latter is not. Also, it is annoying to have an element related to the instrument engage in motion that is not directly responsive to the intentions of the player. Without the provision of the square sleeve 7, rotation is problematical as ever present in the action of a cable type control having a free end. It will be understood in looking at FIG. 2, that whereas the inner wire 17 of the cable 4 attaches to the shank 8 of the damping plate 1. The outer sheath thereof 7 attaches to the bracket 5. The material actually used by the applicants to serve as the cushions or pads on the discs of the damping plate was felt, a standard damping material in musical applications, and it was found to function effectively in the present context as well.

Notwithstanding the loudness of which timpani are capable, the actual excursion of the membrane at the vertical extremities is only slight being a fraction of an inch at the most. For this reason, the damping plate is seated quite close to the vellum in its fully withdrawn or retracted position. Therefore, there is relatively little motion of the foot on the foot control to actuate the device.

That the foot control represents the most distal portion of the cable is clear by referring to FIGS. 1 and 2. There is, then, no mechanical attachment of the pedal control to the timpano as there is with the foot control encorporated into machine tuning means, for example. Consequently, the foot control is free to be moved about on the floor, the distance from the drum it controls being limited solely by the length of cable provided. It should be parenthetically added that while the foot control of the inbuilt machine tuning means, speaking in general, is used only occasionally, the foot control of the present device would be under constant use, the use of damping and muting being throughout necessary in any piece of music. As previously indicated the length of cable should be adequate to permit placing the foot control completely to the opposite side of the player as the drum to whose damper it connects. That the foot control can, would the player so wish, be fixedly attached to a drum, whether that it controls, as by means of a clamp, is considered self evident. While it is possible with available parts to have the control cable detachable from the shell, inserting in a special socket made for remote cable controls, and thereby eliminate any possibility of obtrusiveness by the cables during transporting, this factor is seen as not overly significant and has, therefore, not been included in the practical embodiments of the applicants. As a practical matter, the cable may be wrapped and tied about, provided the radius of curvature is maintained adequate so as to prevent folding and so deforming it.

The foot control of the mechanical embodiment as seen in FIG. 2 is similar to a lever used as a throttle control for small engines, with certain modifications. The underside of the lever should have a rubber stop 16 to eliminate noise and minimize wear to the lever. It should have built-in stops that prevent bending of the inner wire 17, and Nylon washers and steel spring washers that give a smooth feel to the operation of the control. As may be seen in FIG. 2 this lever 9 is comprised of little more than an angle of flat steel stock having a rotary joint 10 at the apex of the angle 18 and an attachment at the shorter arm 19 for insertion of the inner wire 17. The rotary joint 10 is attached to the mounting bracket 11 continuous with which is the extension 12 which secures the outer sheath 20 of the cable 4. Arens Controls, Inc., of Evanston, Illinois produces lever controls, of which certain ones, such as their Model 516–032, are usable for the present purpose. Such a control as seen in FIG. 2 is mounted with the lever having fully withdrawn from the outer sheath 20 the inner wire 17, a condition that presents the lever 9 upside down from the position assumed ordinarily. This position of the lever is maintained by a spring 13 that extends from a hole drilled in the longer arm 14 of the lever 9 to the wall of the containing box of the foot control 15. The spring 13, by automatically reinstating this fully extended position for the inner wire 17 of the control 15, serves to automatically retract the damping plate 1 from the membrane whenever the foot is removed from the foot control 15. Accidental actuation cannot therefore be attributable to the mechanism, but necessitates miscalculation by the player. The tension of the spring 13 should be adequate to present a suitable amount of resistance that the player is given a positive impression as to the degree of depression at every instant, while it should avoid being of such large magnitude that it tends to divert the player's attention and become nocuous thus. The foregoing represents an embodiment of preference, where there are included mechanical parts that effect physical contact.

Additionally, we have experimented with electromechanical means, and have as a result discovered that these may provide certain advantages, for example, in the use of an electromechanical mechanism, specifically a solenoid, a fixed pressure or force of impact is imparted to the membrane regardless of the pressure with which the foot control is depressed, because this resulting action, while its time of occurrence is responsive to the foot switching action, is nevertheless derived as to its motive means from another source. The one force is accordingly independent of the other. As the force with which the foot control itself is depressed varies in response to such factors as the angle of approach, how securely the position of the foot is fixed by positive contact of the heel against the floor, along with yet other factors which might jeopardize flawless operation, the proposal of electrical embodiments does present certain practical aspects.

Definitely ruled out of the question, however, is any application of a solenoid or for that matter any other means that unduly distort the character of the vibration of the membrane. With respect to solenoids, this has the practical effect of completely disallowing a situation in which the plunger, a relatively heavy object in the scheme of things here, is permanently joined to the membrane and is partially contained in the core so that upon actuation the membrane is thereby drawn downwards. Such a contrivance would likewise have to present itself in triplicate, the membrane being unstoppable by the application of pressure at but one point upon its surface anyhow. The support of three plungers and their communication with the cores containing them make such a solution most defective. Inasmuch as the armature must be susceptible of temporary magnetization, it will be appreciated that there is no feather light substance that might be used thus to elude the substance of the objection thereto.

The relation of the solenoid to the remainder of the mechanism is rather that it replaces the push-pull remote control. The solenoid is situated at the point where the cable connects to the damping plate 1.

In using solenoids, it has become clear that those of the alternating current kind are not preferred in the present application. If ac solenoids do not fully seat against the stop or butt, undesirable 60Hz noise results. However, in such full sealing or insertion, there is a considerable noise generated that has a snapping effect and is referred to as the hammer-blow effect. The alternative with ac solenoids is then a choice between one or the other of unacceptable kinds of noise. Considerable experimentation shows that there is no genuinely practical solution to this inherent difficulty with ac solenoids. By a meticulous positioning of the apparatus within the timpano in connection with the encorporation of a spring-supported damping plate, it is possible to minimize the overall noise. Specifically, the spring suspension permits damping plate-to-membrane contact prior to the instant at which the plunger is seated against the butt. It therefore stabilizes and cushions the action. Such a procedure produces a mechanism superior to the unmodified solenoid, but requires a degree of adjustment not consonant with the need for practicality. Apart from the considerable noise generated by a not fully seated armature with an ac solenoid, it is to be noted, that in this state, induction is incomplete and that consequently there is inrush current that materially reduces the solenoid's life expectancy. With ac solenoids, any element in the device, particularly the suspension, that is not fixed stiffly, will itself produce 60Hz noise and vibration when the solenoid is in this state. The desirability of ac solenoids over dc is simply that they eliminate the necessity for a power supply, working directly off the city mains. Having had access to 60Hz rated solenoids, not much thought has been expended in considering operation at higher frequencies. This is only sensible, since given the favorable qualities of dc solenoids at the added expense of providing a power supply, it does not appear economically efficacious to inure such expense for an ac convertor or generator that would support the operation of a higher frequency solenoid, ac solenoids already known to be inferior for this purpose. Were an ac solenoid nevertheless used, an onset-of-stroke force greater than that provided by the bare solenoid would require a ballast reactor with power-factor correcting capacitor assembly, and were higher frequency operation to be employed in spite of the disadvantages associated therewith G this latter auxiliary equipment could be of smaller size appropriate to the smaller wavelength. It may be safely anticipated that at higher frequency, a given solenoid would function with greater efficiency. This is especially true if a ballast is included, since at frequencies in the range of 300 to 600 Hx, smaller lightweight ballasts of the inductive type or small and simple capacitance-type ballasts not practical at 60Hz would provide a gain in overall efficiency. But a ballast is itself at times problematic on account of the necessity to select one of the correct rating, maintenance, and the fact that the ballast itself may become a source of noise. In this connection, it should be pointed out that such higher frequencies nevertheless all fall within the audible spectrum of hearing. Due to this latter factor, the ballast must itself be vibration isolated as by means of absorbent material. And while ballasts are noise rated, these ratings are quite unreliable in practice, a Class A or quitest type at times generating quite a din. From the foregoing discussion, it may be appreciated that the use of ac solenoids is not preferred.

The advantage in using a direct-current solenoid is, then, that it poses no constant threat of producing noise at its operational frequency or of further passing this on to its supporting and otherwise neighboring structures. Consequently, its mounting need not be so meticulous or precise a necessary feature where it is expected that the purchaser will himself undertake installation. Whereas an ac solenoid must go entirely to its seat to avoid overheating and burnout, a dc solenoid can be held slightly short of seating and thus have rid of its operation the presently unacceptable hammer-blow effect, with adverse effect of acceptable degree considered contextually as to efficiency drop. The problem using a dc solenoid is to determine which particular unit of this kind presents a stroke characterized by a force distribution adequate to terminate membrane vibration and yet not so great as to cause rapid wear to that additional stop necessary of introduction in the present application in order to halt the plunger just prior to seating and thereby obviate the hammer-blow effect. With reference to the Guardian Electric Co. line of solenoids, the applicants find that their model 16-P Continuous is suitable. Near to seating, the model specified develops approximately three pounds of force. The direct current is supplied from batteries or a power supply that the manufacturer of the solenoid can immediately specify. The manufacturer of these components is further able to specify immediately the elements necessary to construct a small dedicated power supply, and for these reasons, there is nothing to be gained by detailing these factors. It may be appreciated that dc solenoids are available with magnetic cushions and floating stops which further lessen the problem of plunger pounding or hammer-blow, some firms producing such units even in the push-type. It may be further understood that while all design experimentation was carried out with steel-clad plunger electromagnets, these, notwithstanding their emphasized hammer-blow that may be eliminated with the dc type, do present a correct stroke force distribution, inciding against the membrane with sufficient impact. Nothing stated here should be so interpreted as to limit solenoid types for the application at hand. Thus, for example, the use of two-coil plunger electromagnets of the general horseshoe form and various methods of construction of all types to meet diverse design criteria should not be interpreted as having been excluded for the instant object by reason of any specificity in the foregoing discussion. Among these types are stopped steel-clad solenoid and plunger types; plungers of different lengths relative to their accompanying cores or solenoids; the use of toggles, cams, or bell cranks employed in connection with electromagnets in order to obtain force-distance characteristics different from those exhibited by the electromagnet alone; the encorporation of simple levers; those having specially shaped and proportioned coils, plungers, armatures, or air gaps; and the encorporation of magnetic shunts or coned plungers and stops (see the chapter in Knowlton, Standard Handbook for Electrical Engineers, various editions, by C. R. Underhill).

Remanence, less of a problem with dc magnets in the first place, can be eliminated by reversing the direction of the current and limiting the reversed current to a strength just sufficient to effect demagnetization as, for example, by the use of a resistor. It may be said that no such problem was encountered with dc solenoids. The fact that the plunger is kept from a total and full-force seating by the auxiliary stop to which allusion was made previously means that a slight air-gap remains, and this too assists in the elimination of remanence. Were remanence present beyond a minimal degree, as indeed it was with an ac solenoid tested, the result thereof would be delayed release seen as stickiness, the significance of which is that it would place an unacceptable limit on the speed of repeatable bearing of the timpano in a more pronounced case.

Inasmuch as the present application is best served by a solenoid of quick response and quick release, it seems most efficacious simply to minimize undersurface impact noise and plunger pounding noise by means of the plunger stop added as already described. It should be noted, however, that another way to lessen these noise sources would be to effect a reduction in plunger velocity according to means well known in the art. These include, for example, the placement of copper or aluminum tubes around cores or plungers to produce neutralizing secondary currents for slow operation and units in which a leather bellows with a variable air vent, an oil dashpot, or similar device is employed to retard the motion. That electromechanical and electromagnetic devices afford demagnetization by a light current reversal is common knowledge to those in the electrical arts.

Figure 4:
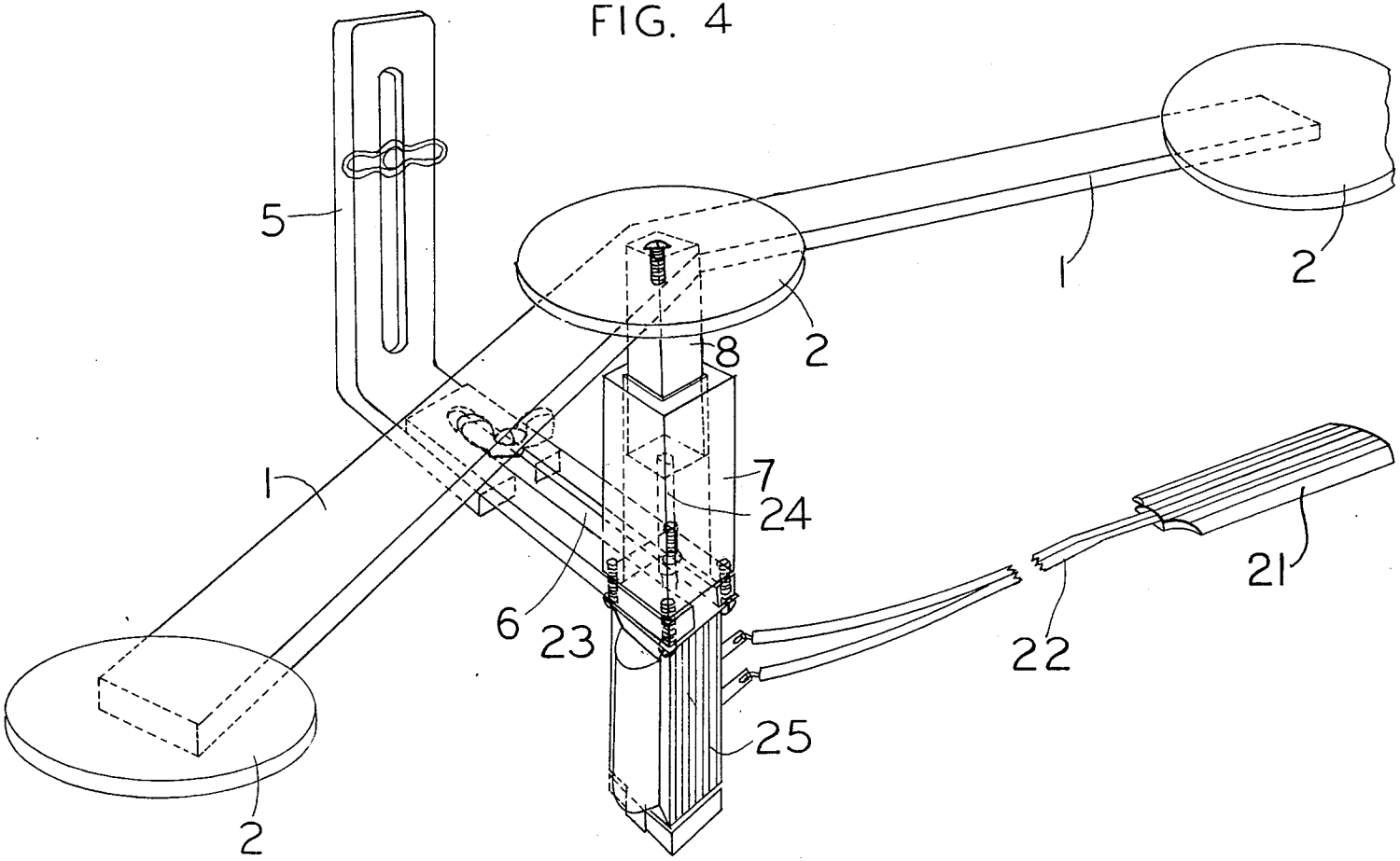
FIG. 4 is a perspective view of an embodiment encorporating a solenoid.

Referring to FIG. 4, shown in an embodiment encorporating a solenoid, which, in light of the foregoing discussion, will be understood as preferably of dc energization. As indicated previously, in our solenoid embodiment, the solenoid is placed in a position corresponding to that of the push-pull remote cable control in the mechanical embodiment, so as to effectually replace it. Cutler-Hammer models 10360-H57 and 10360-H63 are of suitable specifications to serve as second source supplies, however, these are costly. Guardian Electric Companies 16P Continuous is far less costly, suitable for the present purpose, and that with which the applicants secured the best results. The foot control in an electrical embodiment is, of course, an electrical switch. The only provision statable for this component is that it must be rated so as to match the electrical element of reference. The ribbon or tape switches seem to produce no clicking sound and are unobtrusive. The position of any foot switch can be temporarily secured by means of adhesive tape crossing over it from and back to the floor. Otherwise, the foot control whether mechanical or electrical can be weighted so as to sit firmly at the point preferred. It is possible to use one and the same foot switch 21 with solenoids of either ac or dc operation, it being understood that the voltage would be less with dc. The wire 22 is common lamp cord with ac and common patch or speaker type cord with dc. The attachment of the solenoid 23 is similar to that of the control cable in the mechanical embodiment already described, the nonmagnetic plunger extension 24 attaching to the shank 8 of the damping plate 1, and the bracket permanently affixed to the solenoid 25 attaching to the bracket 5. Otherwise, the identity and disposition of the various elements are unchanged. In order to take advantage of this factor, the numbering of the damping plate and the elements associated with it has been retained, it therefore being a simple matter to interpret the prior specification in terms of either embodiment to the extent that they share their elements. As solenoids are of abrupt operational characteristics, notwithstanding the fact that they vary in this according to the components with which they are associated as well as their basic character as already reviewed in brief, it is advantageous in terms of kettle protection, to place a smaller thickness of padding along the kettleward face of the kettleward portion of the supporting bracket 5. Specifically, this is ¼ inch felt stripping. This is affixed to the bracket by means of an adhesive such as the pressure sensitive 3663-0 from Paisley Products Division, Standard Brands Corp., for example.

Figures 5, 6:
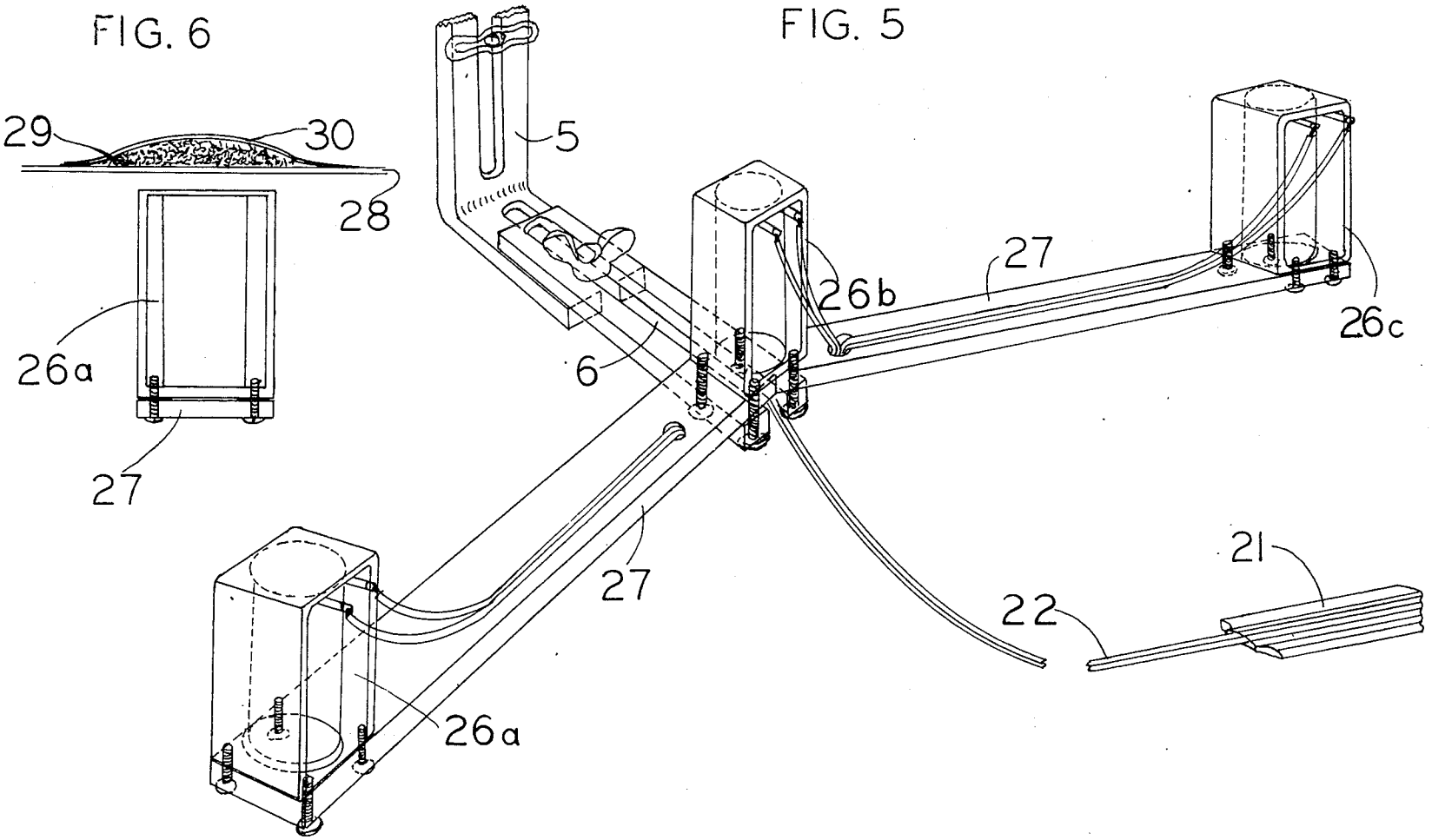
FIG. 5 is a perspective view of an embodiment encorporating three tractive electromagnets.
FIG. 6 is a side view of one electromagnet of the three such as are shown in FIG. 5 in its relationship to the membrane and magnetic material applied thereto.

It may be of interest that the relative costs of the three embodiments specified herein are in rising order mechanical, electromechanical, electromagnetic As indicated previously, an advantage is seen in electromagnetic embodiments in that they are nonmechanical, having no moving parts. While it is possible to so channelize the magnetic flux that a single magnet could be used, this is viewed as having little practical meaning owing to the accession of precision adjustments thereby inured both in the manufacturing and installation of the device of invention. Consequently, a single magnet which for all practical purposes would require three times the rating of individual magnets anyway, is foregone. These three electromagnets may be of either the horseshoe type such as is used in doorbells only of higher rating, or may be of the clapper type, it being understood that in the latter event there is, of course, no physical attachment in the form of a joining lever to the clapper element. As shown in FIG. 5, the three electromagnets 26*a*, 26*b*, and 26*c*, are of the latter tractive type and may be further characterized as dc tractive. Such magnets are obtainable from the Magnetool Company, of Troy, Michigan, and Intermagnetics General Corporation, of Guilderland, New York, for example. It should be clear that since the three electromagnets 26*a*, 26*b* and 26*c* are of like orientation, their force fields remain mutually exclusive. These magnets are, insofar as it is able to be attained, identical to one another. These magnets are fixedly positioned in relation to the membrane by permanent securement in the brace 27 that is in turn permanently attached to the sidewall of the kettle. This brace is preferably of nonmagnetic material so as to avoid shunting available flux thereby diverting from utilization a portion of the energy available. This brace may be of a stiff plastic material, for example, of suitable thickness so as not to be fractured. Ordinarily, the total magnetic pull (expressed as mechanical pressure, of course) need not exceed 5 pounds, and often may be considerably less. The precise magnitude of the necessary pressure is not statable in brief since it is responsive to the size of the drum to which the device is applied as well as the tuning, equivalent to a certain degree of vellum tautness. Adequate experimental experience with these instruments teaches that the proper approach to stopping them lies in operation of a minimal force over a wide spanse of the membrane so directed as to effect the areas of maximum displacement as previously discussed, rather than in applying considerable pressure at one or even two localized points on the membrane. Application of pressure at a single point on the vellum, cannot, owing to the vibratory character, stop it, and the application of greater force will simply proceed until its magnitude exceeds the rupture strength of the membrane material. Application of pressure at two points about five inches apart along the concentric of the membrane at which the primary and secondary vibratory areas are located, will, in fact, terminate further vibration, but only when the degree of pressure reaches about thirty pounds at each point, if not more. Hence, the pattern of discs and magnets in the present embodiment represents that appearing to the applicants to be the most practical. In terms of the present embodiment, the sensible requirement appears to be for three electromagnets. As seen in FIG. 5, the brace 27 is affixed to the kettle by means of the bracket 5, not ordinarily deemed necessary of multiple attachment points to the kettle, the pressure exerted ordinarily anticipated as on the order of that first specified. The pole faces of these electromagnets are situated on the order of one-half inch beneath the underside of the membrane and face it upwardly. At this air-gap distance, a tractive magnet of ten thousand ampere-turns produces about 30 pounds of pressure. Adjustment is more readily accomplished by installation of a magnet somewhat overrated and thereafter increasing the air-gap distance, rather than trying and erring with various magnet units of differing ratings. It may therefore be explained that in practice, the three magnets are of 5000 ampere-turns and further adjustment is secured merely by adjusting the air-gap distance. To this end, a groove-wingnut combination like that seen in the previous embodiments is provided. That upon testing the device of invention and thereby determining this distance optimal for a specific drum can be followed in any of the foregoing embodiments by permanent fixation of the bracket at this point as by means of rivets replacing the wingnut is viewed as obvious; and that the rivets are of greater breadth than the groove is viewed likewise. Inasmuch as the magnets will be of relatively low rating and the only metals anticipated in the surrounding kettle are aluminum, which is paramagnetic, and copper, which is diamagnetic, no appreciable shunting is anticipated such as to require shielding. Provision of shielding, should it in some cases be necessary, would not, however be inventive, shielding means therefor being ordinary in themselves.

As is the case with solenoids, manufacturers of electromagnets of the bar or armature type are prepared to detail power supply requirements immediately, and this being so, no attention need be given the matter here. It will be appreciated that the special value of bar electromagnets, as solenoid and plunger types is that they deliver the correct amount of force regardless of whether the pedal is squarely negotiated. There is, it cannot be denied, at times a certain detriment in this uncontrollable invariance, but usually, and especially in fast and complicated passages, this factor is properly interpretable as distinctly advantageous. While the applicants do not herewith specify an embodiment actuatable either mechanically or electromechanically in one and the same specimen, it is considered obvious that a push-type solenoid could be actuated mechanically in the absence of energizing current. The substance of this is merely that by such selectability in operative mode, the player may choose that appearing to him more suitable relative to the musical and technical requirements at hand. Apart from the fact that tractive electromagnets present no moving parts, it is to be emphasized that there is no impact against the membrane. Furthermore, such magnets may be of small diameter and since no damping plate is necessary and the supporting brace 27 may be of narrow dimensions, there need be only minimal obturation to the passage of the internal pressure wave trains. The foot switch may include a rheostat.

As seen in FIG. 6 for the magnet 26*a*, placed in the same central axis as the three magnets and supported by the membrane 28 are three areas of soft iron filings 29. "Mylar," for example, is of great tensile strength but weak in shear. For this reason, the three patches of iron filings 29 are supported on the membrane 28 so as to obviate the contingency of puncture. Specifically, the iron filings 29 are spread and impressed upon the adhesive surface of highly pliant tape such as thinly guaged surgical tape 30, for example. This is then glued to the surface of the membrane on the outside thereof and directly above the respective magnet poles, unless, of course, and as is preferable, two-sided adhesive tape is available. That the diameter of these tape discs 30 and the iron filing patches they carry 29 is of the same diameter as the magnet poles, should be evident. A vellum manufactured as inclusive of magnetic matter is claimed.

It may be felt that further versatility would be imparted to these devices were they further provided with an interlocking distribution or latching system, by which is meant a means that would permit those respective of any combination of the drums to be simultaneously actuated such that, for example, one could on a first use damp drums I, II, and V, and then on a subsequent use actuate drums III, IV, and VI, for example. This ancillary device would then comprise a pedal control panel allowing damper actuating according to any combination. But further thought will show that the switching theory involved in inherently available, in that the foot controls are freely situatable anywhere on the floor according to the wishes of the player. Thus, these controls can be arranged about a central point and the player can take them in any combination. Or, these controls can be rearranged by the player at that instant in the music when he is free to do so into rows which he may then take in under a single foot as he might another such row possibly present. It should be recollected that many players prefer being seated while playing, and for these players especially, such activity poses no difficulty.

The applicants having considered alternate embodiments using permanent magnets, pneumatics, hydraulics, vacuums, and caliper or disc brake-like devices do not see these as inventive over or presenting advantage over the embodiments duly disclosed by them in the foregoing specification.

That specimens of the foregoing genus permit the avoidance of unwanted glissando between quickly tuned tones without the development of considerable skill of the player that after all is not foolproof even where much effort has gone into its development, and that in permitting stifling of multiple drums to avoid their sympathetic vibration a greater absolute number of drums may be controlled by a single player, the device of invention represents an improvement in the playing technique of the timpano, should now be clear. These advantages taken in combination with those indicated previously mean that from the viewpoint of the orchestral timpanist, the device of invention represents an innovation of the utmost significance.

It will thus be seen that the objects set forth above, among those made apparent from the preceding description, are efficiently attained and, since certain changes may be made in the above construction and different embodiments of the invention could be made without departing from the scope thereof, it is intended that all matter contained in the above description or shown in the accompanying drawings shall be interpreted as illustrative and not in a limiting sense.

It is also to be understood that the following claims are intended to cover all of the generic and specific features of the invention herein described, and all of the statements of the scope of the invention which, as a matter of language, might be said to fall therebetween.

We claim:

1. An apparatus for use by an instrumentalist wishing to silence a timpano without using his hands, said timpano having a shell portion and a head portion, said apparatus comprising, in combination, means spaced from the surface of said timpano head for arresting movement of said head at least at spaced apart points on the surface of said timpano head, means fixedly mounting at least a portion of said arresting means with respect to said shell portion of said timpano, a movably positionable remote actuator unit including foot control element adapted to be engaged by the foot of an instrumentalist, and means operatively connecting said remote actuator unit to at least a portion of said arresting means, whereby actuation of said foot control element causes operation of said arresting means and consequent silencing of said timpano head.

2. An apparatus as defined in claim 1 in which said arresting means includes a damping element support unit, a plurality of damping plates spaced apart from each other and received on said support unit, a padding material covering the operative surfaces of said damping plates, a support unit positioner extending from said support unit, and a support unit positioner frame associated with said mounting means, said positioner being movable relative to said frame, said connecting means being associated with said positioner and frame, whereby actuating said foot control element causes movement of said positioner toward said timpano head, and whereby said padding material on said damping plates engages said head to silence said timpano.

3. An apparatus as defined in claim 1, wherein said arresting means includes a damping element support unit, a plurality of damping plates disposed thereon and spaced apart from one another, a padding material covering the operative surfaces of said damping plates, a support unit positioner and a support unit positioner frame associated therewith, said frame being secured to said timpano shell by said mounting means, said positioner and said frame including a solenoid having a coil and an armature, and said operative connection including an electrical control, whereby actuating said foot control element causes relative movement between said armature and said coil, and movement of said support unit and its associated damping plates into engagement with said head to silence said timpano.

4. An apparatus as defined in claim 1 wherein said arresting means includes magnetizable material attached to a portion of said timpano head, electromagnetic means spaced closely apart from said portion of said head containing said magnetizable material, said electromagnetic means being positioned by said mounting means, and means for energizing said electromagnetic means upon actuation of said foot control, whereby said electromagnetic means may be actuated by said foot control, to attract said magnetizable material and thereby arrest movement of said timpano head.

5. An apparatus as defined in claim 1 wherein said foot control element includes a relatively fixed portion and a relatively movable pedal portion.

6. An apparatus as defined in claim 1 wherein said means for mounting said arresting means is disposed within the shell of said timpano, beneath said head portion thereof.

7. An apparatus as defined in claim 1 wherein said arresting means lies generally diametrically opposite the area of said timpano head normally struck by an instrumentalist.

8. An apparatus as defined in claim 2 wherein said connecting means is in the form of a sheathed cable, one portion thereof being associated with said foot control element and the other being associated with one of said positioner and said positioner frame, said cable being sufficiently flexible to permit positioning of said foot control at any point desired by said instrumentalist within the length of said sheathed cable.

9. An apparatus as defined in claim 1 which further includes means biasing said foot control element into a position in which said arresting means is rendered inoperative, whereby said arresting means is actuated only during the time in which said foot control is positively actuated by said instrumentalist.

* * * * *